US005733186A

United States Patent [19]

Leibu

[11] Patent Number: 5,733,186

[45] Date of Patent: Mar. 31, 1998

[54] MULTIPLE COIN TUBE CHANGER OPERABLE WITHIN EXISTING VENDING MACHINE

[75] Inventor: Mark H. Leibu, St. Louis, Mo.

[73] Assignee: Coin Acceptors, Inc., St. Louis, Mo.

[21] Appl. No.: 633,299

[22] Filed: Apr. 17, 1996

[51] Int. Cl.[6] ..... G07D 1/02

[52] U.S. Cl. ..... 453/20

[58] Field of Search ..... 194/215, 216, 194/217, 218, 229; 453/1, 2, 20; 364/479.01, 479.02, 479.06, 479.08

[56] References Cited

U.S. PATENT DOCUMENTS

| | | | |
|---|---|---|---|
| 3,841,456 | 10/1974 | Levasseur . | |
| 3,963,035 | 6/1976 | Levasseur . | |
| 4,462,512 | 7/1984 | Schuller | 194/217 |
| 4,499,982 | 2/1985 | Sugimoto et al. | 194/217 |
| 4,587,984 | 5/1986 | Levasseur et al. . | |
| 4,625,852 | 12/1986 | Hoormann . | |
| 4,646,904 | 3/1987 | Hoormann . | |
| 4,706,202 | 11/1987 | Kobayashi et al. | 364/479.02 |
| 4,739,869 | 4/1988 | Hoormannn . | |
| 4,763,769 | 8/1988 | Levasseur . | |
| 5,036,966 | 8/1991 | Kaspar et al. | 194/217 |
| 5,184,708 | 2/1993 | Levasseur | 194/217 |
| 5,293,979 | 3/1994 | Levasseur . | |
| 5,310,035 | 5/1994 | Dobransky, Jr. et al. | 194/217 |
| 5,542,519 | 8/1996 | Weston et al. | 194/217 |

FOREIGN PATENT DOCUMENTS

| | | | |
|---|---|---|---|
| 2098776 | 11/1982 | United Kingdom | 194/218 |

*Primary Examiner*—F. J. Bartuska

*Attorney, Agent, or Firm*—Haverstock, Garrett & Roberts

[57] ABSTRACT

A four coin tube/four coin denomination coin changer is configured for installation and operation within existing vending machines, which existing vending machines have vending machine controllers configured to recognize and operate with coin changers having only three coin tubes and which vending machine controllers are operable to effect payout of coins from such three coin tube coin changers by signals produced on three coin tube interface lines. The four coin tube coin changer includes a processor which, when installed, is operatively connected to the three coin tube interface lines of the vending machine. The processor of the four coin tube coin changer is programmed to interpret signals received from the coin tube interface lines as particular monetary values, and the processor buffers or stores such values thereby accumulating a change payout amount. The processor is operable in various modes to effect payout of the accumulated change payout amount.

20 Claims, 4 Drawing Sheets

MULTIPLE COIN TUBE CHANGER OPERABLE WITHIN EXISTING VENDING MACHINE

FIELD OF THE INVENTION

This invention relates generally to vending machines and more particularly, to four coin tube coin changers configured for installation and operation in vending machines having controllers, or microprocessors, which are configured for operation with three coin tube coin changers, without requiring replacement of the vending machine controller or modification of the vending machine controller software.

BACKGROUND OF THE INVENTION

Many existing vending machines include vending machine controllers (VMCs) configured for operation with coin changers having only three coin tubes, each coin tube storing a respective coin denomination. Operation of such vending machines is typically as follows. The changer validates and determines the denomination of incoming coins and communicates the value of each accepted coin to the VMC. The changer also communicates the status of the three coin tubes (full, empty, or number of coins) to the VMC. The VMC accumulates credit by adding and storing each coin value received from the changer, controls the vend operation, and thereafter determines the change to be paid out, if any. Although the three coin tubes are associated with the changer, it is the VMC which controls payout of coins. Interface of the VMC and the changer includes three lines, one associated with each coin tube. When the VMC effects a signal on a given coin tube line, a coin is paid out from the respective coin tube by operation of a solenoid, motor, or any other known payout means. For example, each time the VMC effects a high signal on a given coin tube line, the payout means is activated and a single coin is paid out from the respective coin tube. Multiple coins are similarly paid out from a given coin tube by multiple high signals on the coin tube's associated interface line. Thus, in a traditional three coin tube/three coin denomination scheme, the VMC directly controls change payout from the coin changer's three coin tubes.

The demand for vending machines capable of paying out change from four coin tubes and, particularly, capable of accepting and paying out four coin denominations rather than three, is ever increasing. One way to accomplish this is to construct coin changers having four coin tubes, each coin tube storing one coin denomination. However, to retain the aforementioned VMC control of change payout requires an additional interface line between the VMC and the fourth coin tube and also requires modification of the VMC software to enable the VMC to recognize the existence of the fourth coin tube and its associated coin denomination. Such modifications are costly and time consuming, particularly when performed during each installation of a four coin tube coin changer.

Accordingly, it is desirable and advantageous to provide a four coin tube coin changer which is easily installable in and operable with existing vending machines. It also is desirable and advantageous to provide a method of controlling change payout from a four coin tube coin changer installed in a vending machine having a controller which is only operable to control change payout from three coin tubes.

A principal object of the present invention is to provide a four coin tube coin changer which is configured for installation and operation in existing vending machines.

Another object of the present invention is to provide a four coin tube coin changer which is operable with existing vending machines to provide payback of change from each of the four coin tubes.

Still another object of the present invention is to provide a four coin tube coin changer which is configured for operation with existing vending machine controllers which are only configured to recognize three coin tubes, without requiring modification of the vending machine controller and without requiring additional interface lines between the vending machine controller and the changer.

Another object of the present invention is to provide a four coin tube coin changer which is relatively inexpensive to install.

SUMMARY OF THE INVENTION

These and other objects of the invention are attained by a coin changer which includes four coin tubes, each coin tube configured for storing a particular coin denomination. For example, in the United States currency system the coin denominations could be nickel, dime, quarter and dollar. The changer interfaces with existing vending machine controllers (VMCs), such VMCs being configured to control change payout from only three coin tubes. Because the VMC is only configured to operate within a three coin tube/three coin denomination vending scheme, the VMC has only three coin tube lines which, for U.S. currency, may correspond to the nickel, dime and quarter coin denominations of the changer.

A processing means associated with the present coin changer is connected to the three coin tube lines and is configured to buffer change payout signals received from the VMC. The buffering is achieved by storing and accumulating values associated with each VMC coin payout signal.

During a vend operation, coins are deposited in the changer and the changer analyzes such coins to determine if they are valid and to determine their denomination. If a given coin is valid, its denomination or value is communicated to the VMC which stores the value as credit and adds to it the value of any other coins validated during the particular vend operation. After a vend selection is made, the VMC effects a vend of the selected product and then determines the amount of change to be paid out by subtracting the price of the vended item from the stored credit. The VMC then begins effecting signals on the three coin tube lines to attempt to payout the change mount. However, in the present changer construction, the three coin tube lines are connected to the coin changer processing means rather than directly to the coin tubes or coin payout means. Each signal on a given coin tube line is representative of the value of a particular coin denomination and the processing means is programmed to store the particular value as a variable PBUFFER. Multiple signals each represent respective values and the processing means adds each respective value to the value stored as variable PBUFFER.

The changer processing means is operable to effect payout of coins from each of the four coin tubes so as to provide coin payout in four denominations of coins. The present changer may be operable to effect coin payout in a variety of modes, including a mode in which the accumulated PBUFFER value is monitored such that when the stored value of PBUFFER reaches a predetermined level, a predetermined value is paid out and that predetermined value is subtracted from the stored value of PBUFFER. In such a mode, the changer may begin paying out change while still receiving signals on the three coin tube lines, thereby paying out change faster than a mode in which the changer begins to payout change only after the coin tube line signals stop. Further, the changer can payout change according to any one of numerous known coin payout routines such as the well known least coin payout routine in which the change is paid out in the least number of coins possible. It is also understood that the present changer could be programmed to payout change in accordance with more advanced coin payout routines by appropriate programming of the changer processing means.

DETAILED DESCRIPTION OF THE DRAWINGS

Figure 1:
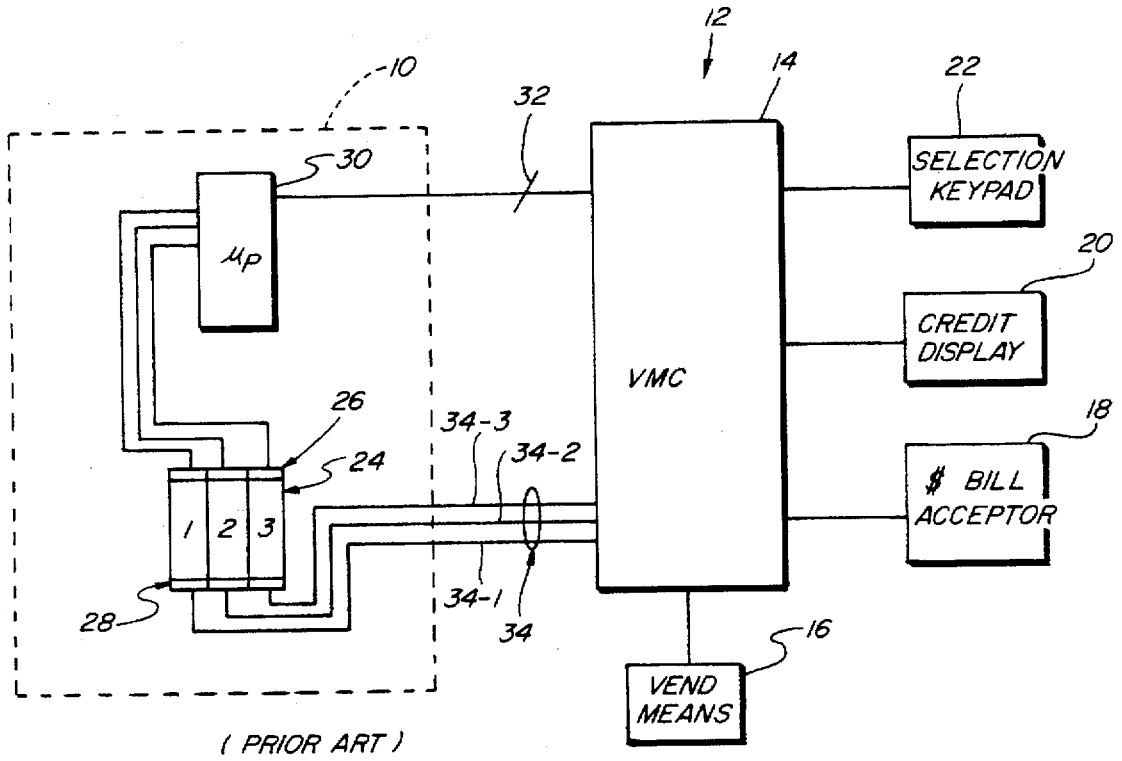
FIG. 1 is a partial block diagram illustration of a three coin tube coin changer installed within a vending machine.

FIG. 1 is a partial block diagram illustration of a prior art three coin tube coin changer 10 installed within a vending machine 12 including a vending machine controller (VMC) 14. The VMC 14 includes connections to vend means 16 for effecting vend of selected products, a bill acceptor 18 for receiving credit information therefrom, a credit display 20 and a selection keypad 22, operation of each of such devices being known in the art. The changer 10 includes three coin tubes 24, separately identified as coin tubes 1, 2, and 3, having associated coin tube level sensors 26 and payout means 28, and processing means 30. For discussion purposes herein, it is assumed that coin tube 1 stores nickel coins, coin tube 2 stores dime coins, and coin tube 3 stores quarter coins. Connection between the VMC 14 and the changer 10 includes a plurality of lines 32, as indicated by the slash mark, through which information is communicated between the changer processing means 30 and the VMC 14, as well as three coin tube lines 34 which run from the VMC 14 to the three coin tubes 24, and are typically connected to the payout means 28 associated therewith. Thus, line 34-1 is connected to the payout means of coin tube 1, line 34-2 is connected to the payout means of coin tube 2, and line 34-3 is connected to the payout means of coin tube 3. Signals effected by the VMC 14 on the coin tube lines 34 operate the respective payout means 28 and cause coins stored in the coin tubes 24 to be paid out as change. Typically each of the coin tube lines 34 is connected to a corresponding line extending from the respective coin payout means 28.

Figure 2:
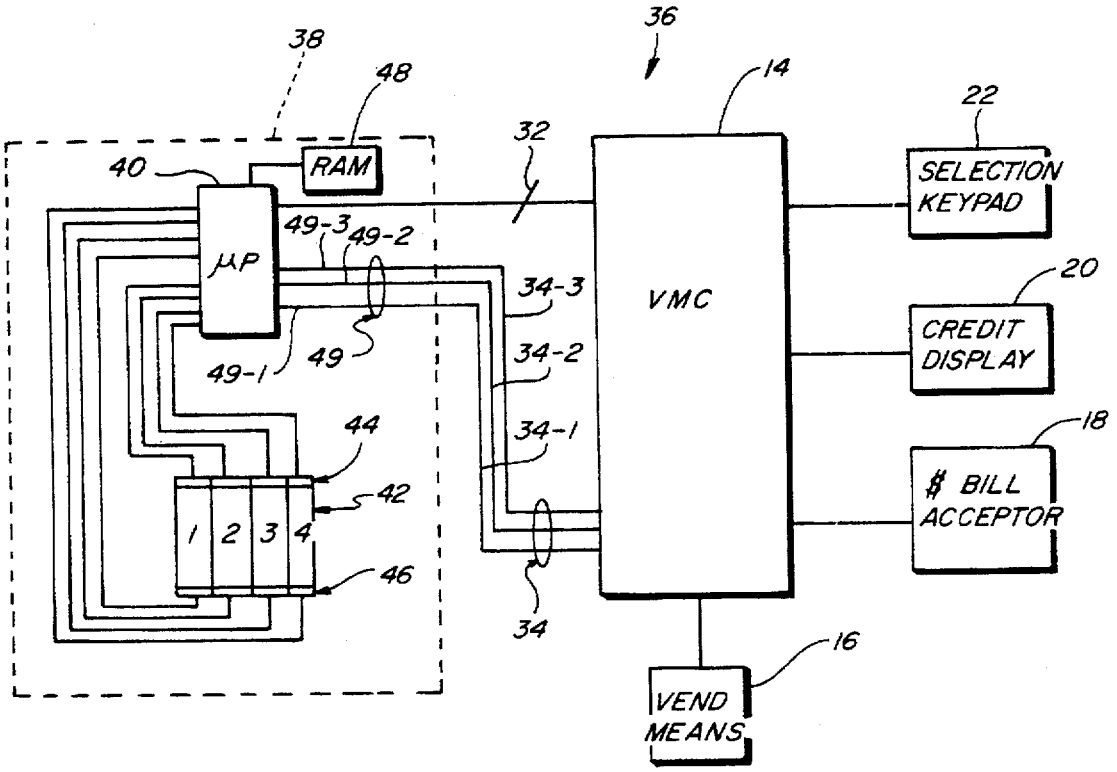
FIG. 2 is a partial block diagram illustration of a four coin tube coin changer constructed in accordance with the present invention and installed within a vending machine.

A similar vending machine 36 is illustrated in FIG. 2 but includes a four coin tube coin changer 38 constructed in accordance with the present invention. The coin changer 38 includes processing means 40, four coin tubes 42 having associated coin tube level sensors 44 and payout means 46, and memory means 48. Memory means 48 may be RAM memory which is used for storing information as described below. However, it is understood that other memory may be utilized, including memory integral with the processing means 40. Lines 32 extend between the processing means 40 and the VMC 14 similar to the FIG. 1 configuration. However, in the present changer 38, the three coin tube lines 34 are connected to three corresponding lines 49, separately designated 49-1, 49-2, and 49-3, of the changer 38 such that signals on the respective coin tube lines 34-1, 34-2, and 34-3 are directed to the processing means 40 rather than the coin tubes 42. Accordingly, signals effected by the VMC 14 on the coin tube lines 34 do not directly cause coins stored in the coin tubes 42 to be paid out. Rather, signals on the coin tube lines 34 are directed to the processing means 40 which is programmed to interpret such signals.

Figure 3:
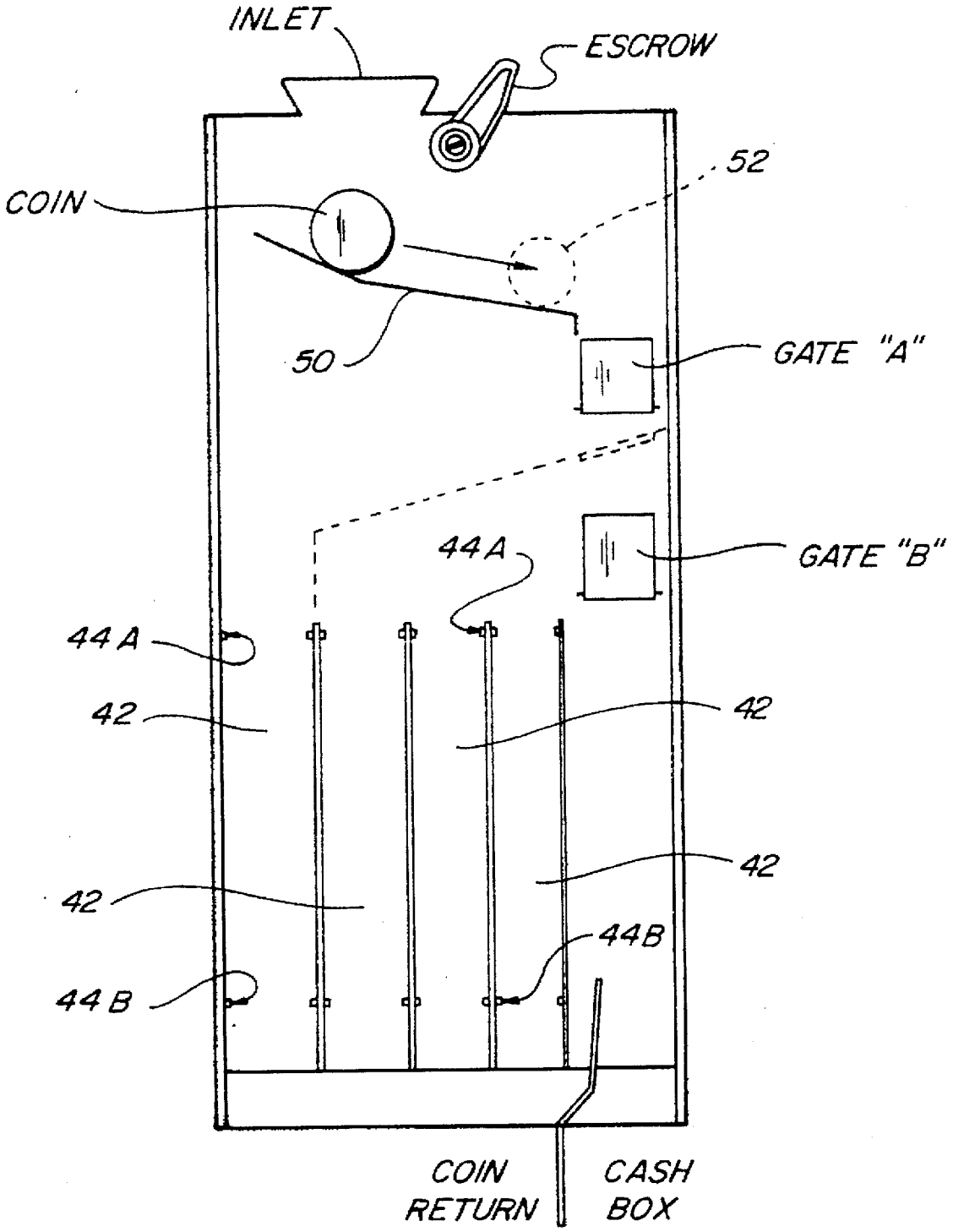
FIG. 3 is a partial front internal and elevational view of a four coin tube coin changer constructed in accordance with the present invention.

FIG. 3 illustrates a from internal view of the four coin tube coin changer 38, including a coin rail 50 having coin sensing means 52 located therealong. Coin sensing means 52 may include optical coin sensors, inductive coin sensors, or combinations thereof, all of which are well known devices for detecting and validating coins. For example, detection and validation of coins in the present coin changer 38 could be performed in accordance with U.S. Pat. No. 4,625,852, U.S. Pat. No. 4,646,904, U.S. Pat. No. 4,739,869, U.S. Pat. No. 4,763,769, or U.S. Pat. No. 5,293,979, each of which is assigned to the assignee of the present invention.

Coin tube level sensors 44A and 44B are also illustrated in FIG. 3, each sensor 44A operable to indicate a full coin tube and each sensor 44B operable to indicate an empty coin tube, where empty and full coin tubes may be represented by predetermined numbers of coins respectively. Such coin tube sensors 44A and 44B may be of the optical, inductive, mechanical, or other known type. Gates such as gate A and gate B are positioned along the coin path. Such gates are typically operable by the processing means 40, shown in FIG. 2, to direct a deposited coin to the coin tubes 42, the cash box, or the coin return.

Referring again to FIG. 2, the processing means 40 is operably connected to each of the coin payout means 46 in order to effect payout of coins from each of the four coin tubes 42. The coin tube lines 34 are connected to the processing means 40 and a given signal on one of such lines is interpreted by the processing means 40 as a monetary value. For example, a signal on the coin tube line 34-1, which in the prior art construction of FIG. 1 is associated with the nickel coin tube, is interpreted by the processing means 40 as five (5) cents. The processing means 40 stores this value in a variable, herein designated PBUFFER. As mentioned above, this value may be stored in memory means 48 or other memory, including memory which may form part of the processing means 40. Multiple signals on the coin tube lines 34 are interpreted by the processing means 40 as multiple monetary values, each one being added to the value stored as variable PBUFFER, such that the processing means 40 accumulates the value of change that must be paid out based upon signals received on the coin tube lines 34. The coin changer 38 is programmed to accumulate the value PBUFFER and payout either a portion of the value PBUFFER or the entire value PBUFFER, in accordance with the modes depicted in the flow chart illustrations of FIGS. 4 and 5. A given value may be paid out according to a predetermined payout routine, such as the least coin payout routine or other known payout routines.

Figure 4:
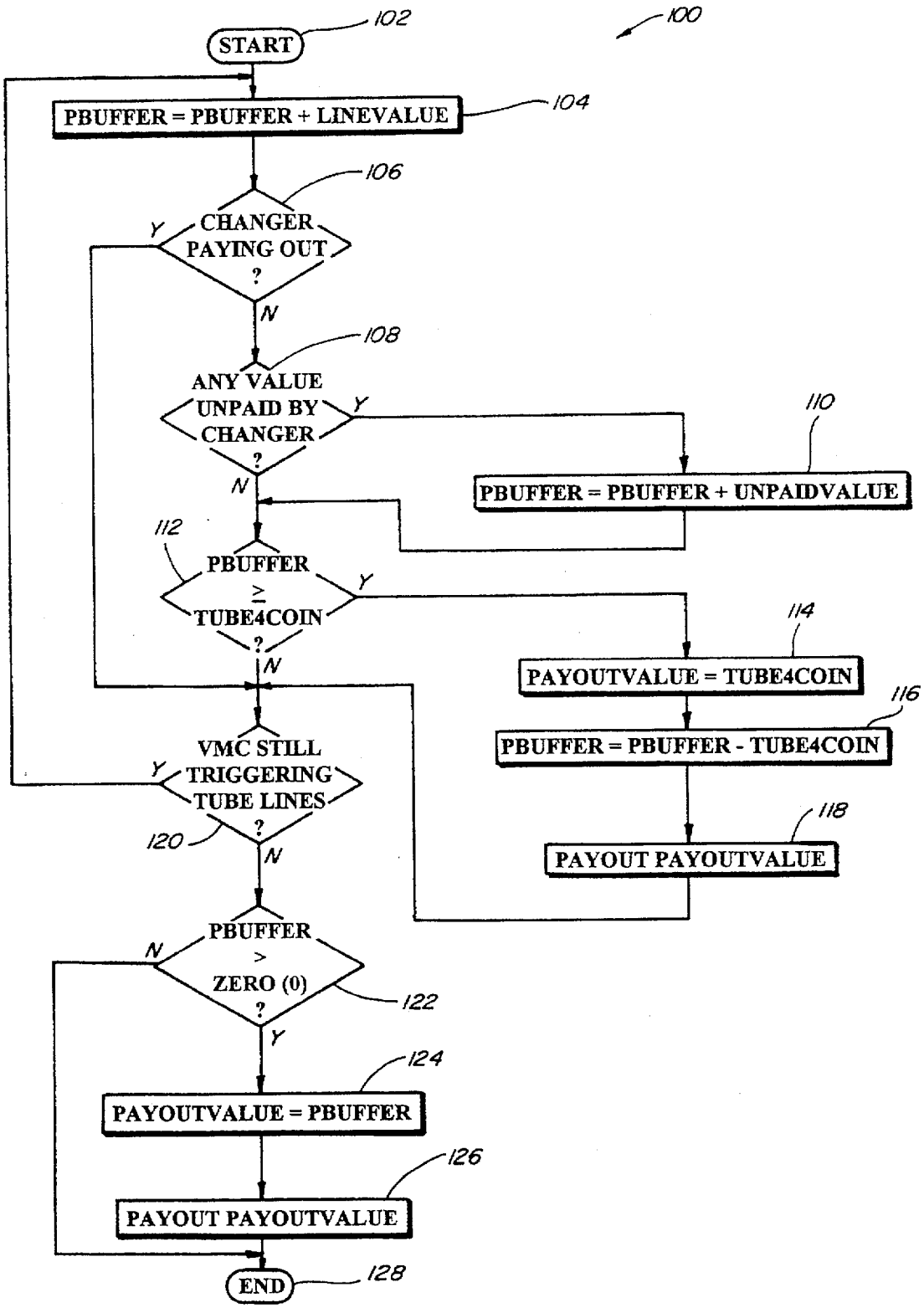
FIG. 4 is a flow chart illustrating one changer operating mode of buffering values associated with signals received on the coin tube lines.

FIG. 4 is a flow chart 100 illustration of a designated "normal" mode of operation of the present coin changer 38. In such a mode, the coin changer 38 buffers the values associated with the coin tube line signals up to a predetermined value, the predetermined value being the value associated with the coin tube coin denomination which the VMC does not recognize. Thus, if the VMC recognizes only nickel, dime and quarter tubes, the coin tube line signals are buffered by the changer 38 until PBUFFER is greater than or equal to one dollar, the coin denomination associated with the unrecognized fourth coin tube. Such operation is explained with reference to FIG. 4 as follows. Processing begins at a step 102 designated START, and at a step 104 the value associated with a signal on one of the coin tube lines 34, hereinafter LINEVALUE, is added to the variable PBUFFER as indicated by the equation PBUFFER=PBUFFER+LINEVALUE. It is assumed that at the start of processing the value PBUFFER is set to zero (0). Moving to a step 106, it is determined if the changer 38 is in the process of paying out coins. If the changer 38 is not paying out coins, processing moves to a step 108 where it is determined if there is any value which the changer 38 did not payout in a previous payout attempt, hereinafter UNPAIDVALUE. If there is some UNPAIDVALUE it is added back to the PBUFFER value at a step 110 as indicated by the equation PBUFFER=PBUFFER+UNPAIDVALUE. At a step 112, the PBUFFER variable is checked to determine if the value associated therewith is greater than or equal to the value associated with the coin denomination stored in the unrecognized fourth coin tube, hereinafter TUBE4COIN, as indicated by (PBUFFER≧TUBE4COIN?). If so, the variable PAYOUTVALUE is set at the value of TUBE4COIN at a step 114, PBUFFER is decreased by the value of TUBE4COIN at a step 116, and the changer 38 begins paying out the PAYOUTVALUE at a step 118.

Moving to a step 120, if signals are still being effected by the VMC 14 on any of the coin tube lines 34, processing returns to step 104 to assure that the values associated with such signals are added to the PBUFFER value. Referring again to step 106, if the changer 38 is in the process of paying out coins, steps 108 through 118 are bypassed and processing moves directly to step 120. When no more signals are received on any of the coin tube lines 34, processing moves to a step 122. Typically, step 120 will be satisfied when there is no signal on any of the coin tube lines 34 for a predetermined amount of time, such as 1.5 seconds. At step 122 the PBUFFER variable is checked to determine if there is any value associated therewith that needs to be paid out, as indicated by (PBUFFER>ZERO (0)?). If so, the PAYOUTVALUE is set to the value of PBUFFER at a step 124 and the PAYOUTVALUE is paid out at a step 126, with processing ending at a step 128 designated END.

The normal buffer mode described above with respect to FIG. 4 and flow chart 100 may be utilized to reduce the total amount of time required to payout change. If a large amount of change, greater than the value TUBE4COIN, is to be paid out, steps 114–118 will effect payout of a portion of the change while the processing means 40 is still receiving signals on the coin tube lines 34. Thus, rather than waiting to accumulate the entire amount of change that needs to be paid out, the changer 38 pays out a portion of the amount while accumulating the remaining change amount. When a large amount of change is to be paid out, the time savings can be significant because the VMC 14 is typically limited with respect to the speed with which it effects signals on the coin tube lines 34, and the changer processing means 40 is similarly limited in the speed with which it can effect payout of coins from the coin tubes 42.

Figure 5:
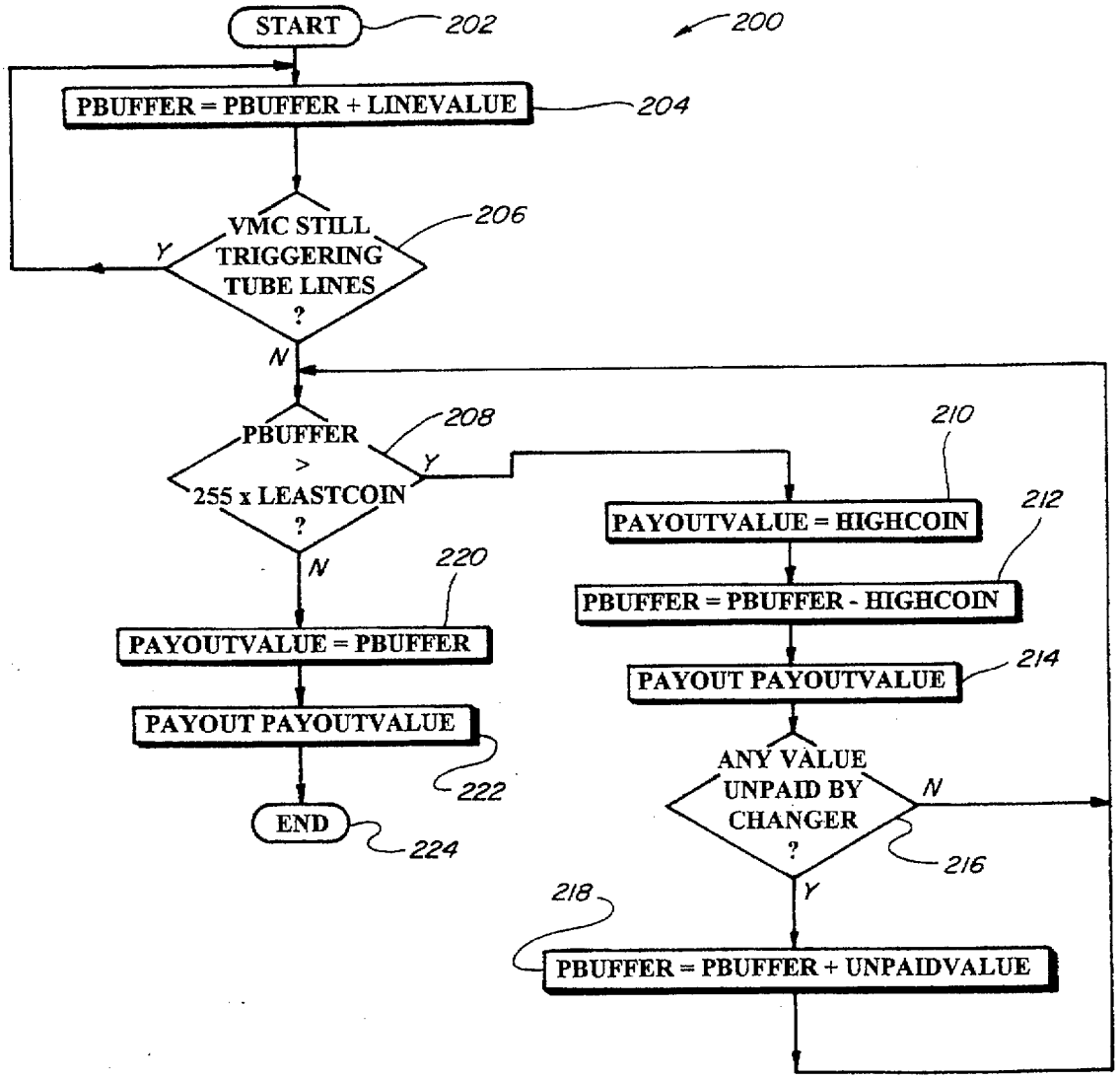
FIG. 5 is a flow chart illustrating an alternative changer operating mode of buffering values associated with signals received on the coin tube lines.

An alternative operating mode, referred to as a "full" buffer mode is illustrated in flow chart 200 in FIG. 5. As opposed to flow chart 100, flow chart 200 is indicative of a mode in which the changer 38 accumulates all of the change before paying out any portion of it. Beginning at a step 202, designated START, processing moves to a step 204 where PBUFFER is increased by an amount LINEVALUE as indicated by the equation PBUFFER=PBUFFER+LINEVALUE. At a step 206, if the processing means 40 is still receiving a signal on any one of the coin tube lines 34, processing returns to step 204. Thus, repetition of steps 204 & 206 continues until the entire change amount is buffered or accumulated. Once the VMC 14 stops effecting signals on the coin tube lines 34 for at least a predetermined length of time, processing moves to a step 208 where the accumulated PBUFFER value is compared with a predetermined value of 255 times the value associated with the lowest unit of the particular currency system, (255×LEASTCOIN). For example, in U.S. currency the lowest unit of currency is one cent and, therefore, the predetermined value would be 255 times one cent, or $2.55. It is noted that the lowest unit of the currency system need not be stored in any of the coin tubes 42. If PBUFFER is greater than (255×LEASTCOIN), at a step 210 the PAYOUTVALUE is set to HIGHCOIN, the highest value associated with a coin denomination stored in one of the four coin tubes. PBUFFER is then decreased by the value HIGHCOIN at a step 212 and the changer 38 begins paying out PAYOUTVALUE at a step 214. At a step 216, if the entire PAYOUTVALUE amount is paid out by the changer, processing returns to step 208. Otherwise, the UNPAIDVALUE is added back to PBUFFER at a step 218 and processing again moves to step 208. If PBUFFER is less than or equal to (255×LEASTCOIN) processing moves from step 208 to a step 220 where PAYOUTVALUE is set to the value associated with PBUFFER and the changer 38 then begins paying out PAYOUTVALUE at a step 222, with processing ending at a step 224 designated END.

Referring to decision step 208 and steps 210–218, this portion of flow chart 200 is important when the vending machine 36 is operating in accordance with the now standardized multi drop bus protocol. For a single payout operation, the multi drop bus protocol only allows for payout of total coinage of less than or equal to 255 times the lowest unit of currency or (255×LEASTCOIN). Accordingly, if the total change to be paid out exceeds (255×LEASTCOIN), change must be paid out in more than one payout operation. Steps 210–218 provide an additional payout operation for such cases. With respect to step 210, PAYOUTVALUE is set to HIGHCOIN in order to accommodate a least coin payout routine, which payout scheme the changer may be utilizing. Paying out the value HIGHCOIN at step 214 assures that least coin payout will be followed if possible. However, it is understood that at step 210, the PAYOUTVALUE could be set to some other predetermined value.

With respect to the operating modes illustrated in flow chart 100 and flow chart 200, it is recognized that other operating modes could be utilized in association with the present coin changer. The important aspect of the present invention is that through buffering the values associated with coin tube line signals, a four coin tube coin changer is operable to payout coins from four coin tubes even when associated with a vending machine controller which recognizes only three coin tubes. Further, it is recognized that, utilizing the teachings herein, a coin changer having M coin tubes could be configured for operation with a vending machine controller which recognizes only N coin tubes, where M−N=1. Similarly, the herein described buffering techniques could be utilized in connection with a coin changer which has more than four coin tubes, even where the vending machine controller recognizes only three coin tubes.

From the preceding description of the illustrated embodiment, it is evident that the objects of the invention are attained. In particular, a four coin tube/four coin denomination coin changer operable with existing vending machines to provide acceptance and payout of four coin denominations has been described. Although the invention has been described and illustrated in detail, it is to be clearly understood that the same is intended by way of illustration and example only and is not to be taken by way of limitation. It is recognized that various modifications, alterations and other applications for the subject invention are possible and all such modifications, alterations and other applications are deemed to be covered by the invention. For example, although the invention has been described with reference to the U.S. currency system, it is understood that the invention could be associated with other currency systems. Further, although the dollar coin is described herein as the unrecognized coin denomination, it is suggested that the unrecognized coin denomination could be the nickel, dime, or quarter coin. In such a case, the value TUBE4COIN should correspond to whichever coin denomination is not recognized by the VMC. In addition, it is suggested that two or more of the four coin tubes could store the same coin denomination, such as nickels, and that the coin changer could then be utilized in vending systems where it is desirous to increase the number of nickels, or other coins, available to be paid out as change. Accordingly, the spirit and scope of the invention are to be limited only by the terms of the appended claims.

What is claimed is:

1. In a vending machine including a controller having only three coin tube interface lines, the controller operable to determine an amount of change due during a vend operation and to produce at least one signal on one of the coin tube interface lines so as to attempt to payout the determined change amount, the improvement comprising:

a coin changer including four coin tubes, each coin tube storing one coin denomination therein and having coin payout means associated therewith, the coin changer further including processing means and memory means associated therewith, the processing means operably connected to the coin payout means of each coin tube, the processing means connected to the three coin tube interface lines of the vending machine controller so as to receive signals therefrom, the processing means programmed to assign a value to each signal received from a given coin tube interface line and to associate the assigned value with a predetermined variable, so that for a given plurality of signals received on the three coin tube interface lines, the processing means assigns a value to each signal and associates each assigned value with the predetermined variable such that all assigned values are accumulated and the accumulated value is associated with the predetermined variable, and the processing means is operable to effect production of a plurality of signals in attempt to payout coins having respective values which sum to an amount substantially corresponding to the accumulated value associated with the predetermined variable.

2. In the vending machine of claim 1, wherein the processing means is programmed to determine if the accumulated value associated with the predetermined variable is greater than a first predetermined value, and if so, to first attempt to payout coins having respective values which sum to a second predetermined value and to reduce the accumulated value by the second predetermined value.

3. In the vending machine of claim 2, wherein the first predetermined value is a value associated with a coin denomination stored in one of the four coin tubes.

4. In the vending machine of claim 3, wherein the second predetermined value is a value associated with a coin denomination stored in one of the four coin tubes.

5. In the vending machine of claim 2, wherein the first predetermined value is 255 times the smallest unit of the currency type associated with the stored coin denominations.

6. In the vending machine of claim 5, wherein the second predetermined value is the value associated with the highest coin denomination stored in one of the four coin tubes.

7. In the vending machine of claim 1, wherein the processing means effects production of the plurality of signals according to a predetermined payout routine.

8. A coin changer installable in a vending machine which includes a controller operable to determine an amount of change due during a vend operation, N coin tube interface lines connected to the controller, the controller operable to produce coin payout signals on the N coin tube interface lines in attempt to directly effect payout of coins from the coin changer, the coin changer comprising:

M coin tubes, each coin tube storing one coin type therein, where M>N, coin payout means associated with each coin tube, and processing means operatively connected to each of the coin payout means, the processing means configured for connection to each of the N coin tube interface lines so as to receive coin payout signals therefrom, the processing means operable to accumulate a change payout amount in response to coin payout signals received from the N coin tube interface lines, the processing means operable in combination with the coin payout means of each coin tube to effect payout of coins therefrom, the processing means further operable to compare the accumulated change payout amount with a predetermined amount before effecting payout of any coins, wherein, if the accumulated change payout amount is greater than the predetermined amount, the processing means is operable to first attempt to payout coins having respective values which sum to a predetermined payout amount, and to decrease the accumulated change payout amount by the predetermined payout amount.

9. The coin changer of claim 8 wherein M−N=1.

10. The coin changer of claim 9 wherein M=4 and N=3.

11. The coin changer of claim 8 wherein the predetermined amount is a value associated with a coin type stored in one of the M coin tubes.

12. The coin changer of claim 8 wherein the predetermined amount is 255 times the smallest unit of the currency type associated with the coin types stored in the M coin tubes.

13. The coin changer of claim 8 wherein, if the entire predetermined payout amount is not paid out, the processing means is operable to increase the accumulated change payout amount by the unpaid amount.

14. The coin changer of claim 8 wherein M=4 and four different coin types are stored in the four coin tubes, one coin type per coin tube.

15. A method of paying out change from a vending machine including a controller and a coin changer associated therewith so as to receive signals therefrom, the coin changer including a plurality of coin tubes each storing one coin denomination therein and having coin payout means associated therewith, where the coin changer has more coin tubes than the controller is programmed to recognize, the method comprising:

(a) transmitting a plurality of signals from the controller to the coin changer, (b) assigning, within the coin changer, a value to each of the transmitted signals, (c) accumulating, within the coin changer, the assigned values of the transmitted signals, and (d) producing, within the coin changer, at least one signal which effects payout of at least one coin from one of the plurality of coin tubes.

16. The method of paying out change from a vending machine of claim 15, further comprising the steps of:

(e) prior to step (d), comparing the accumulated value with a predetermined value, and (f) if the accumulated value is greater than the predetermined value, producing, within the coin changer, at least one signal which effects payout of a predetermined payout amount.

17. The method of paying out change from a vending machine of claim 16, further comprising the step of subtracting the predetermined payout amount from the accumulated value.

18. A method of modifying an existing vending machine which includes a controller having three coin tube interface lines operably connected to respective coin payout means associated with the coin tubes of a three coin tube coin changer, so as to configure the vending machine to payout change from four coin tubes, the method comprising:

(a) removing the three coin tube coin changer from the vending machine, (b) installing a four coin tube coin changer within the vending machine, each coin tube storing one coin denomination and each coin tube having payout means associated therewith, the four coin tube coin changer including a processing means operably connected to each of the coin payout means, the four coin tube coin changer including three signal receiving lines connected to the processing means, and (c) connecting the three coin tube interface lines to the three signal receiving lines of the processing means.

19. A coin payout mechanism installable in a vending machine which includes a controller operable to determine an mount of change due during a vend operation, N coin tube interface lines connected to the controller, the controller operable to produce signals on the N coin tube interface lines, the coin payout mechanism comprising:

M coin tubes, each coin tube storing one coin type therein, where M>N and where M–N=1, coin payout means associated with each coin tube, and processing means operably connected to each of the coin payout means, the processing means configured for connection to each of the N coin tube interface lines so as to receive signals therefrom, the processing means operable to accumulate a change payout amount in response to signals received from the N coin tube interface lines, and the processing means operable in combination with the coin payout means of each coin tube to effect payout of coins therefrom.

20. A coin changer configured for installation in a vending machine which is configured for operation in an N coin tube vending scheme, the coin changer comprising:

M coin tubes, each coin tube for storing one coin denomination therein, where M>N and where M=4 and N=3, coin payout means associated with each coin tube, and a processing means including N signal receiving lines connected thereto, the processing means operably connected to each coin payout means, the processing means operable, in response to signals received on the N signal receiving lines, to effect signals which operate the coin payout means in order to payout change, so that for a given change payout operation, the processing means is capable of paying out coins from each of the M coin tubes.

* * * * *

UNITED STATES PATENT AND TRADEMARK OFFICE

CERTIFICATE OF CORRECTION

PATENT NO. : 5,733,186

DATED : March 31, 1998

INVENTOR(S) : Mark H. Leibu

It is certified that error appears in the above-indentified patent and that said Letters Patent is hereby corrected as shown below:

Cover Page, "COIN" should be inserted in the title before "CHANGER"

Column 1, Title, "COIN" should be inserted in the title before "CHANGER"

Column 2, line 47, "mount" should be - - amount - -

Column 10, line 3, "mount" should be - - amount - -

Signed and Sealed this

Sixteenth Day of June, 1998

*Attest:*

*Attesting Officer*

BRUCE LEHMAN

*Commissioner of Patents and Trademarks*